United States Patent [19]

Deuse et al.

[11] 4,236,576

[45] Dec. 2, 1980

[54] HEAT EXCHANGERS WITH TUBE BUNDLES

[75] Inventors: Karl-Heinz Deuse; Witold Drobka, both of Berlin, Fed. Rep. of Germany

[73] Assignee: Borsig GmbH, Berlin, Fed. Rep. of Germany

[21] Appl. No.: 68,886

[22] Filed: Aug. 23, 1979

[30] Foreign Application Priority Data

Sep. 14, 1978 [DE] Fed. Rep. of Germany ..... 2840221

[51] Int. Cl.[3] ..... F28F 9/02; F28D 7/00

[52] U.S. Cl. ..... 165/134 R; 165/158; 165/159

[58] Field of Search ..... 165/11, 70, 134, 173–175, 165/158, 159

[56] References Cited

U.S. PATENT DOCUMENTS

| | | | |
|---|---|---|---|
| 2,834,581 | 5/1958 | Schefels et al. | 165/134 R |
| 2,893,701 | 7/1959 | Bell | 165/11 |
| 3,140,792 | 7/1964 | Harris | 165/134 R |
| 3,356,135 | 12/1967 | Sayre | 165/134 R |
| 3,442,060 | 5/1969 | Guillot et al. | 165/134 R |
| 3,630,274 | 12/1971 | Lievense | 165/134 R |
| 3,771,596 | 11/1973 | Schlichting | 165/158 |
| 3,913,531 | 10/1975 | von Hollen | 165/163 |

FOREIGN PATENT DOCUMENTS

| | | | |
|---|---|---|---|
| 1324945 | 3/1963 | France | 165/134 R |

*Primary Examiner*—Sheldon Richter

*Attorney, Agent, or Firm*—Becker & Becker, Inc.

[57] ABSTRACT

Heat exchanger for heat-transfer between substances of high pressure difference including a shell, a region through which a cooler substance is conveyed; an inlet for the cooler substance; a bundle of tubes arranged in a cooler substance compartment; and riser conduits operatively connectible to the shell and communicating with the compartment, with the substance to be cooled being passed through the tubes having a high temperature at the inlet of the heat exchanger and at the outlet; a tube bottom of predetermined thickness arranged at the heat exchanger inlet; and a device including a support-grating arranged in the vicinity of the tube bottom, operatively connectible to the shell and extending at least nearly perpendicular to the tube bottom in the region through which the cooler substance is conveyed. The heat exchanger also includes a top provided with apertures and the like which are easily accessible from the steam-water space of the heat exchanger with cooling channels being provided which are adapted to be in communication with the apertures and riser conduits provided outside the heat exchanger proper.

7 Claims, 8 Drawing Figures

Fig.5
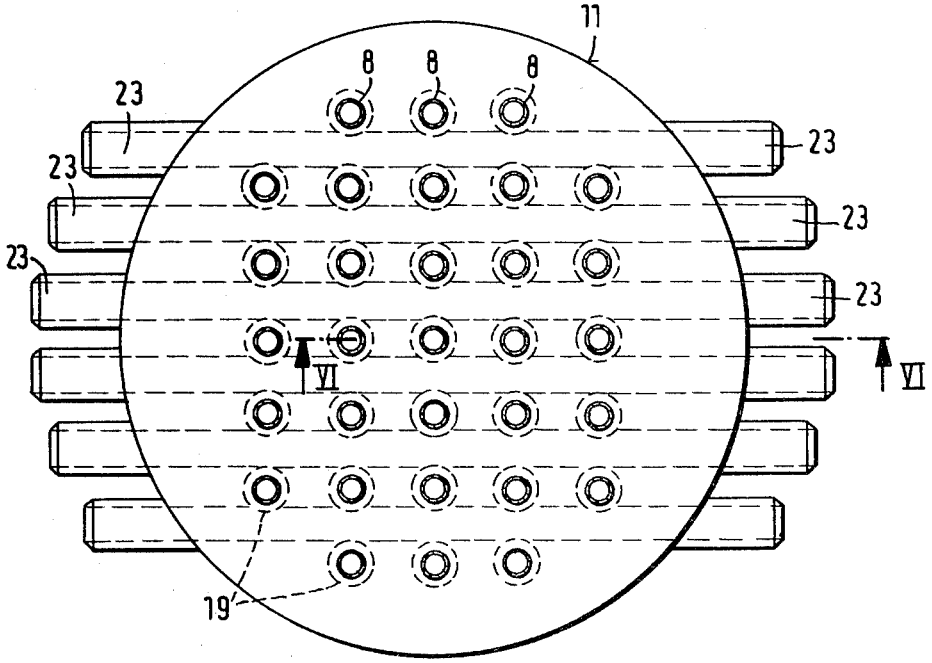
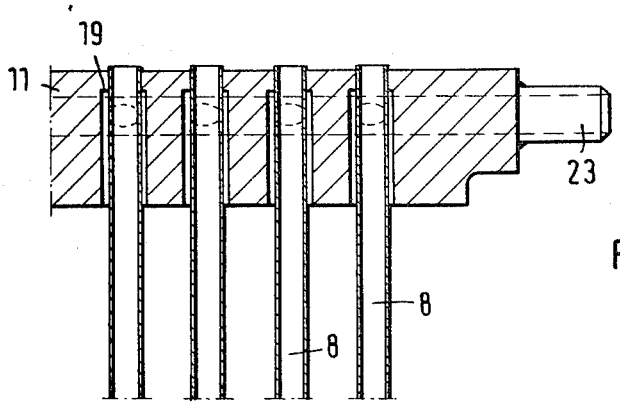
Fig.6

HEAT EXCHANGERS WITH TUBE BUNDLES

The present invention relates to heat exchangers with tube bundles for heat-transfer between substances of considerable pressure differences, with the substance being passed through the tubes of the tube bundles having a very high inlet or entry temperature and a high outlet or exit temperature. The heat exchanger includes a tube bottom at the inlet end for the hot substance, which bottom is thin, and a device which is supported on the shell of the exchanger near the circumference of the thin tube bottom, which device is comprised of a support grid supported so as to be perpendicular to the thin tube bottom in that region of the exchanger through which the cooler substance is passed. The heat exchanger also includes a tube top at the outlet end for the cooled hot substance which outlet tube top, in relation to the inlet tube bottom, is thick.

In such heat exchangers with tube bundles, it is required to ensure, by a corresponding lay-out, that the cooler substance is passed to the one or the several thermally highly stressed tube bottom or bottoms in a manner that the heat given off by these will prevent such a high temperature which would detrimentally affect the strength of the pertaining material.

In order to satisfy such requirements, it is known in heat exchangers with tube bundles, in which only the inlet temperature is of such a magnitude so as to endanger the material of construction of the tube bottom, to make the tube bottom at the inlet end for the hot substance to cooled relatively thin and to arrange a relief device in that region through which the cooler substance is passed in such a way that the cooler substance passed into the heat exchanger can be admitted so as to be close to the thin tube bottom. It is, of course, also possible at high exit temperatures of the substance flowing through the tubes of the tube bundles, for example at 550° C. to 650° C. in the thermal cracking of gas oil (Diesel fuel, liquid petroleum distillate), to provide such a thin tube bottom member with a relief device at the exit end for the cooled hot substance in the region through which the cooler substance is passed. However, such an arrangement is rather substantial in production and, accordingly, expensive in comparison with a thick tube bottom.

It is an object of the present invention to provide at the exit end for the cooled hot substance of a tube bundle heat exchanger such a thick tube top which does not attain such a temperature which would detrimentally affect the strength of the pertaining material of construction thereof, despite high exit temperatures of the hot substance.

This object and other ojects and advantages of the invention will appear more clearly from the following description in connection with the accompanying drawings, in which:

FIG. 5 is a top plan view, similar to that of FIG. 2, of a further embodiment in accordance with the present invention;

FIG. 6 is a partial longitudinal section along line VI—VI in FIG. 5;

Figure 1:
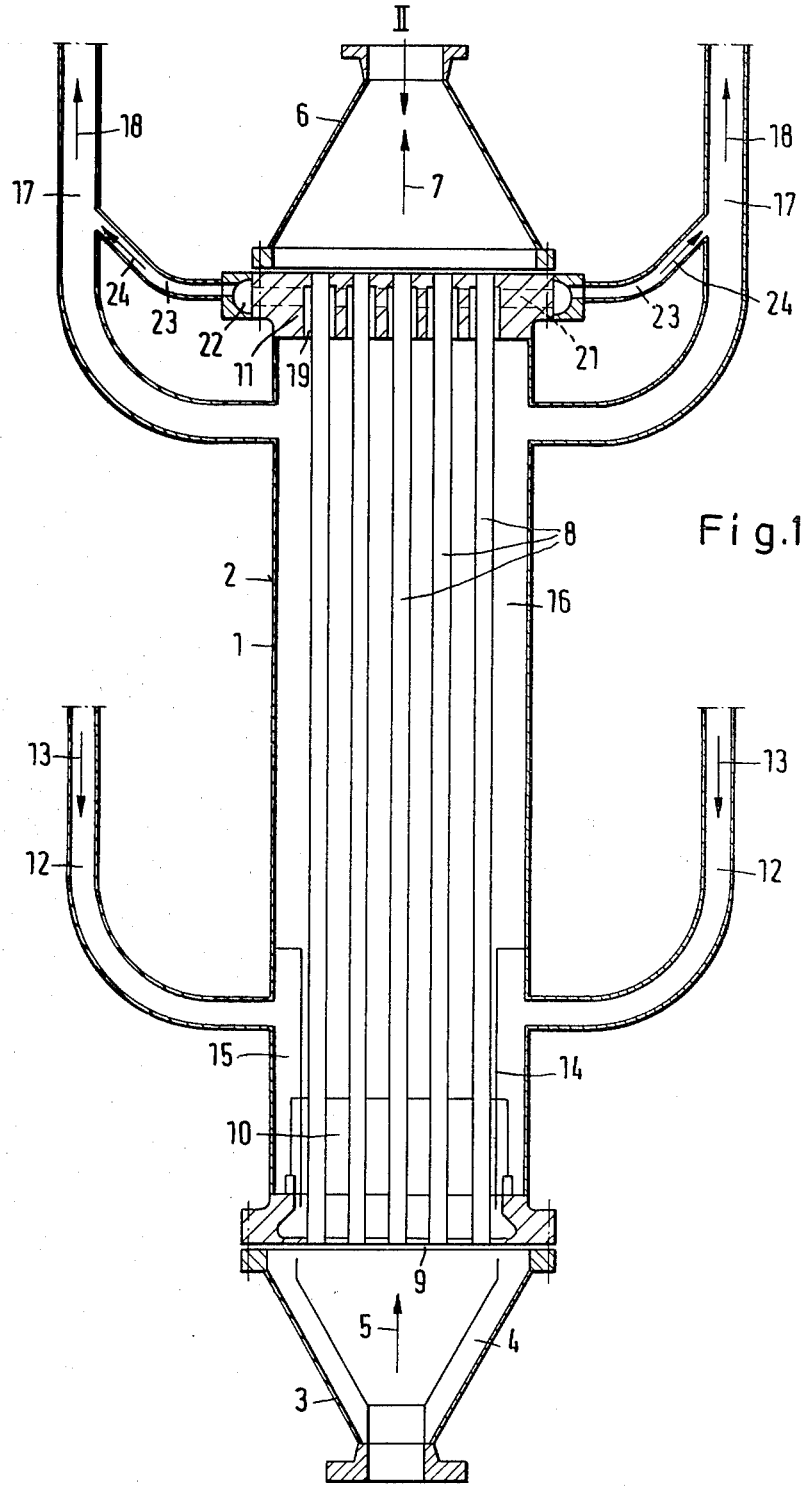
FIG. 1 is a longitudinal sectional view of a vertically arranged heat exchanger with tube bundles, which exchanger has cooling pockets in, and an annular chamber at, the thick tube top; the heat exchanger being generally indicated diagrammatically.
Figure 2:
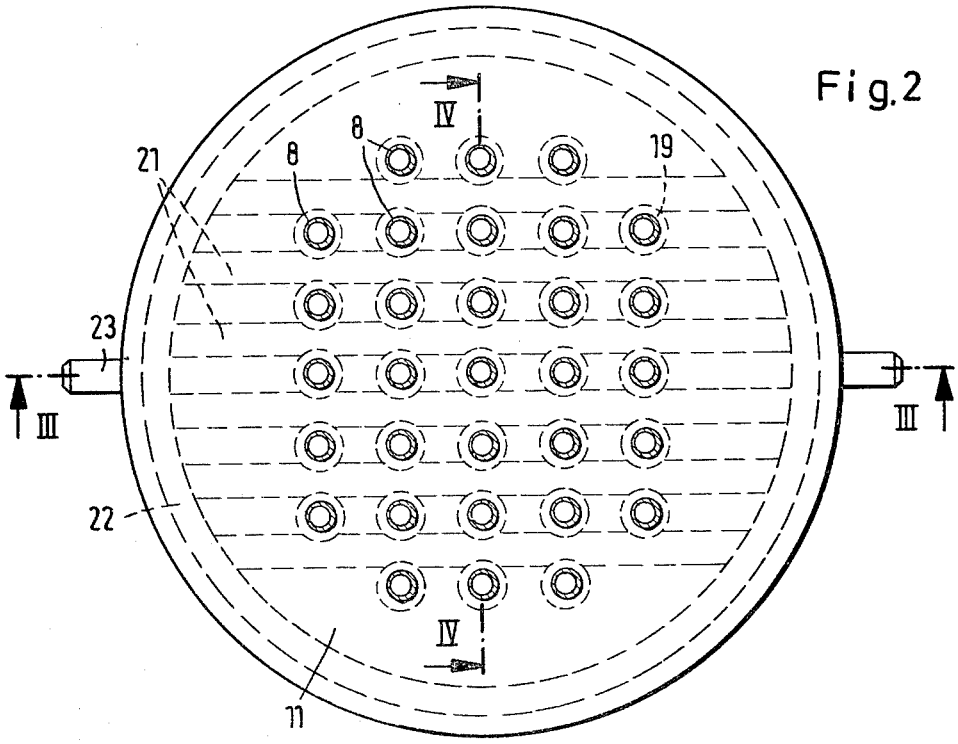
FIG. 2 is a top plan view in the direction of arrow II of FIG. 1 drawn to a larger scale.
Figure 3:
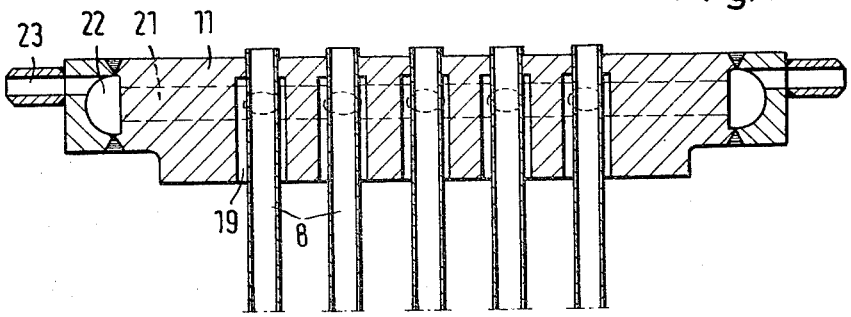
FIG. 3 is a partial longitudinal section along line III—III in FIG. 2.
Figure 4:
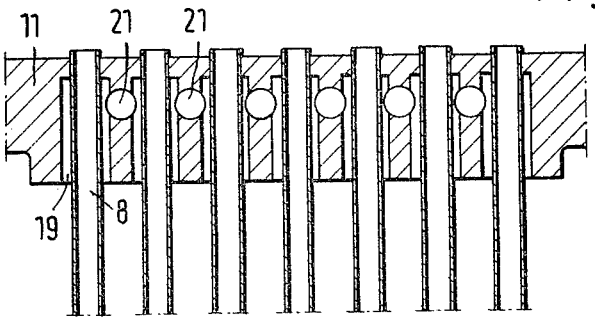
FIG. 4 is a partial longitudinal section along line IV—IV in FIG. 2.

The invention is characterized primarily therein that the thick tube top of the heat exchanger is provided with apertures or recesses and the like which are easily accessible from the steam-water space or compartment of the heat exchanger, and that between the tubes parallel cooling channels are provided which are adapted to be in communication with the apertures and the riser conduits provided outside the heat exchanger proper.

In accordance with a further embodiment of the invention, in order to pass the steam-liquid mixture in a simple, and for the cooling of the tube bottom effective, manner to the cooling channels, the apertures in the thick tube top are in the form of countersunk holes which terminate centrally in the cooling channels or cooling pockets in the form of recesses.

For removal of the steam-water mixture from the thick tube top, in accordance with another embodiment of the invention, the cooling channels are in communication on both sides with an annular chamber which serves to communicate diametrically opposed arranged conduits, e.g. two conduits, with diametrically opposed arranged riser conduits, e.g. two riser conduits. Alternatively, from the respective two ends of each of the cooling channels there is passed a conduit to the adjacent riser conduit.

Referring now particularly to the drawings, the heat exchanger with a tube bundle, the heat exchanger generally being designated by the reference numeral 1, comprises a shell or mantle 2 with an inlet hood or channel 3 which is interiorly provided with an insulating layer 4. The inlet channel 3 serves for receiving the hot substance in the direction indicated by the arrow 5.

At its opposite or exit end, the heat exchanger 1 is provided with an exit hood or channel 6 for the outlet of the cooled hot substance in the direction indicated by the arrow 7. A plurality of tubes or pipes or similar conduits, generally designated by the reference numeral 8, are provided in the shell 2. The tubes 8 are connected to a thin tube bottom 9 at the inlet or entry end for the hot substance, whereat there is provided a support grating 10 for reinforcing or bracing the bottom 9. At the outlet or exit end for the cooled hot substance the tubes 9 are connected to a thick tube top or top member 11. Cooler substance is passed to the exchanger through gravity feed conduits 12, in the direction indicated by the arrows 13, to a water space or chamber 15 formed by a guide mantle 14 which, in turn, is disposed within the shell 2. Next the cooler substance is passed, due to guide sheets in evenly divided form, to the thin tube bottom 9, is then passed to the steam-water space or cooler substance compartment 16, and then predominantly leaves the heat exchanger 1 through the riser conduits 17 in the direction indicated by arrows 18.

Figure 7:
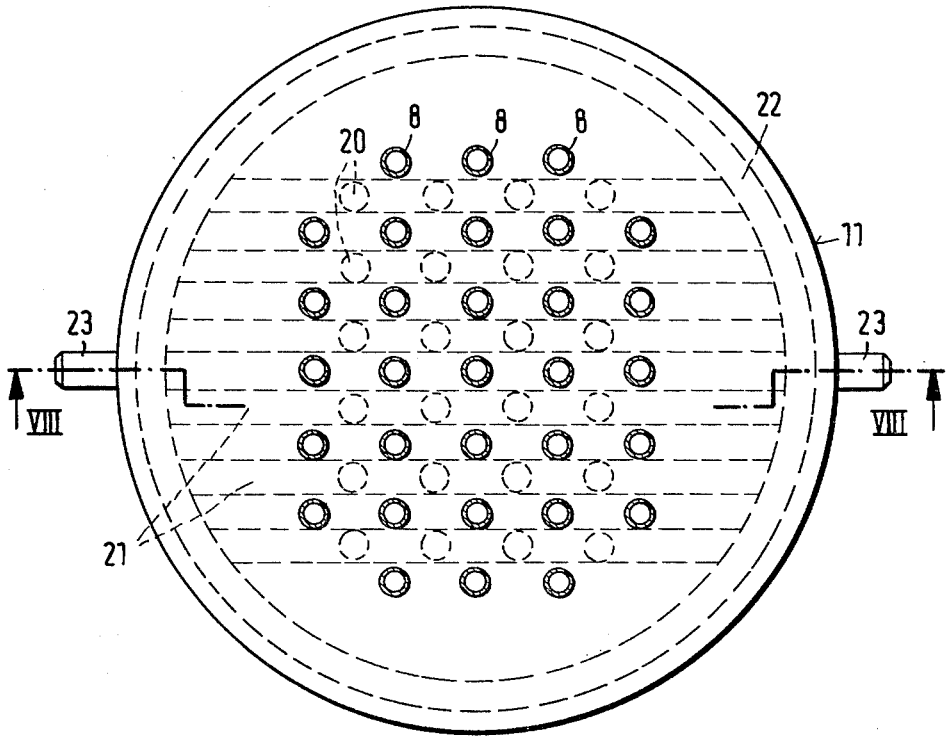
FIG. 7 is a top plan view of a thick tube top similar to FIG. 2 of yet another embodiment in accordance with the invention.
Figure 8:
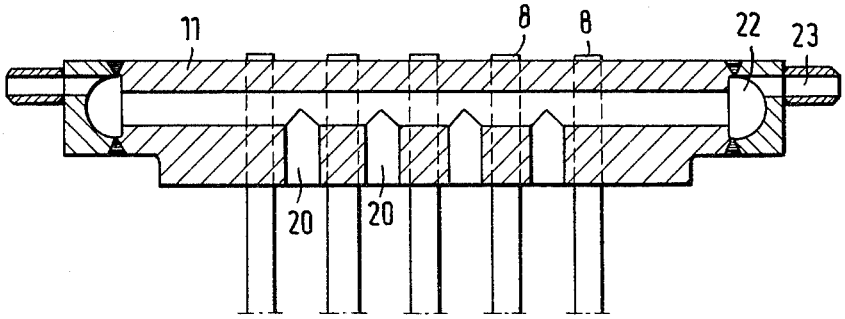
FIG. 8 is a partial longitudinal section along line VIII—VIII in FIG. 7.

The remainder of the steam-water mixture is passed through the pertaining apertures in the thick tube top 11 into cooling channels 21 which extend parallel to each other between the tubes 8. Thence the remainder is either passing through the annular chamber 22 (FIGS. 1 to 4, 7, and 8) or, when an annular chamber 22 is absent, is passed directly (FIGS. 5 and 6) through the communicating conduits 23 into the riser conduits 17 in the direction indicated by arrows 24. The pertaining apertures are, according to FIGS. 1 to 6, in the form of cooling pockets 19, e.g. recesses, about the tubes 8; and are, according to FIGS. 7 and 8, in the form of countersunk holes 20 arranged adjacent the tubes 8 and centrally relative to the cooling channels 21.

The present invention is, of course, in no way restricted to the specific disclosure of the specification and drawings, but also encompasses any modifications within the scope of the appended claims.

What we claim is:

1. A heat exchanger for heat-transfer between substances of high pressure difference, said heat exchanger including a shell; a region through which a pertaining cooler substance is conveyed; an inlet for said cooler substance; a bundle of tubes arranged in a cooler substance compartment; and riser conduit means operatively connectible to said shell and communicating with said compartment, with the substance to be cooled being passed through the pertaining tubes having a predetermined high temperature at the pertaining inlet end of said heat exchanger and a high temperature at the pertaining outlet end thereof; a tube bottom arranged at said heat exchanger inlet end, said tube bottom being of predetermined thickness; and a device including a supportgrating arranged in the vicinity of said tube bottom, operatively conrectible to said shell, and extending at least nearly perpendicular to said tube bottom in said region through which said cooler substance is conveyed, said heat exchanger comprising:

a tube top arranged at said heat exchanger outlet end, said tube top having an effective thickness which is greater than the pertaining predetermined thickness of said tube bottom;

an effective quantity of cooling channels arranged in said tube top and extending parallel to one another between pertaining tubes of said tube bundle;

recess means for communicating said cooler substance with said cooling channels; and conduit means adapted to communicate said channels with said riser conduit means.

2. A heat exchanger according to claim 1, wherein said recess means comprises bores in said tube top adapted to communicate said cooler substance compartment with said cooling channels, the central axes of said bores intersecting the longitudinal axis of a pertaining cooling channel.

3. A heat exchanger according to claim 2, wherein said recess means comprises individual cooling pockets about at least some tubes of said bundle of tubes.

4. A heat exchanger according to claim 3, wherein a cooling pocket comprises a concentric bore about a pertaining tube and adapted to communicate said cooler substance compartment with a pertaining channel.

5. A heat exchanger according to claim 1, wherein said conduit means comprises an annular chamber in said tube top, with pertaining cooling channels communicating with their pertaining ends with said annular chamber, and conduits also in communication with said annular chamber.

6. A heat exchanger according to claim 5, wherein said annular chamber is adapted to communicate at least two of said conduits, said conduits being arranged diametrically opposed to one another and each one conduit being adapted to be in communication with a pertaining one of said riser conduit means.

7. A heat exchanger according to claim 1, wherein each conduit means includes a conduit for each end of each cooling channel, each communicating with said riser conduit means.

* * * * *